US005728238A

United States Patent [19]

Engdahl et al.

[11] Patent Number: 5,728,238

[45] Date of Patent: Mar. 17, 1998

[54] IRON BASED POWDER, COMPONENT PRODUCED THEREFROM AND METHOD OF PRODUCING THE COMPONENT

[75] Inventors: Per Engdahl, Nyhamnsläge; Caroline Lindberg, Höganäs, both of Sweden

[73] Assignee: Höganäs AB, Höganäs, Sweden

[21] Appl. No.: 302,088

[22] Filed: Sep. 6, 1994

Related U.S. Application Data

[63] Continuation of Ser. No. 949,640, Dec. 2, 1992, abandoned.

[30] Foreign Application Priority Data

Jun. 11, 1990 [SE] Sweden ..... 9002070

[51] Int. Cl.[6] ..... C22C 33/02; B22F 1/00

[52] U.S. Cl. ..... 148/337; 75/230; 75/252; 75/246; 419/38; 419/39

[58] Field of Search ..... 148/337; 75/246, 75/230, 252; 419/38, 39

[56] References Cited

U.S. PATENT DOCUMENTS 2,226,520 12/1940 Lenel ..... 75/246
2,291,734 8/1942 Lenel ..... 75/246
3,836,355 9/1974 Lindskog et al. ..... 75/123 D
4,128,420 12/1978 Esper et al. ..... 75/230

FOREIGN PATENT DOCUMENTS 2321103 5/1972 Germany .
2613255 7/1982 Germany .

OTHER PUBLICATIONS

Abstract of Japanese Patent No. 60–75501. Apr. 27, 1985.

*Primary Examiner*—Sikyin Ip
*Attorney, Agent, or Firm*—Burns, Doane, Swecker & Mathis, L.L.P.

[57] ABSTRACT

An iron-based powder for producing impact-resistant components by powder compacting and sintering contains, in addition to Fe, 0.3–0.7% by weight of P, 0.3–3.5% by weight of Mo, and not more than 2% by weight of other alloying elements. A method of powder-metallurgically producing impact-resistant steel components comprises using an iron-based powder which, in addition to Fe, contains 0.3–0.7% by weight of P, preferably 0.35–0.65% by weight of P, 0.3–3.5% by weight of Mo, preferably 0.5–2.5% by weight of Mo, and not more than 2% by weight, preferably not more than 1% by weight, of other alloying elements; compacting the powder into the desired shape; and sintering the compact.

13 Claims, 3 Drawing Sheets

IMPACT ENERGY (J)

100
80
60
40
20
0
0,0
0,2
0,4
0,6
0,8
P(weight-%)

IMPACT ENERGY(J)

100
80
60
40
20
0
0
1
2
3
4 Mo
(weight-%)

IRON BASED POWDER, COMPONENT PRODUCED THEREFROM AND METHOD OF PRODUCING THE COMPONENT

This application is a continuation, of application Ser. No. 07/949,640, filed Dec. 12, 1992, now abandoned.

BACKGROUND OF THE INVENTION

The present invention relates to an iron-based powder for producing impact-resistant components by powder compacting and sintering.

The invention also concerns a powder-metallurgically produced component made from this powder. Finally, the invention bears upon a method of powder-metallurgically producing such a component.

The remaining porosity of sintered powder-metallurgical materials impairs the mechanical properties of the materials, as compared with completely dense materials. This is a result of the pores acting as stress concentrations, as well as reducing the effective volume under stress. Thus, strength, ductility, fatigue strength, macro-hardness etc. in iron-based powder-metallurgical materials decrease as the porosity increases. Impact energy is, however, the property the most adversely affected.

Despite their impaired impact energy, iron-based powder-metallurgical materials are, to a certain extent, used in components requiring high impact energy. Naturally, this necessitates high precision when manufacturing the components, the effect of the porosity on impact energy being well-known.

The impact energy of sintered steel may be increased by alloying with Ni, which augments the strength and ductility of the material and, furthermore, causes shrinkage of the material, i.e. a density increase. The effect of Ni-alloying is especially pronounced when the sintering is carried out at a high temperature, i.e. above 1150° C. Naturally, the high temperature results in a more active sintering and produces rounder pores than do low sintering temperatures. In addition, the rounder pores also increase the impact energy. Alternatively, a more active sintering can be achieved by adding P, which increases strength and ductility, as well as rounds off the pores even at lower sintering temperatures, i.e. below 1150° C.

To sum up, the impact energy of sintered materials can be increased by reducing the stress concentration effect of the pores. This can be achieved by liquid-phase sintering, high-temperature sintering, sintering of a ferritic material, double compacting, and by adding alloying elements having a shrinking effect.

In many cases, however, sufficient impact energy is only achieved with a combination of the above measures, which usually requires extensive and costly processing when using alloying systems known in the powder-metallurgical techniques of today.

SUMMARY OF THE INVENTION

The object of the present invention is, therefore, to provide an iron-based powder which simplifies the processing, yet yields sufficiently impact-resistant components by powder compacting and sintering.

It is further desired that simple powder compacting as well as sintering can be carried out in a belt furnace, i.e. at temperatures below about 1150° C.

This object is achieved by an iron-based powder which, in addition to Fe, contains Mo and P, and in which the content of other alloying elements is maintained on a low level. This material is, inter alia, characterised by the fact that sintering even below 1150° C. results in an impact energy which is higher than that of today's powder-metallurgical materials sintered at higher temperatures. Further, the material has excellent compressibility and is capable of considerable shrinkage, giving a sintered material of high density. For one and the same density, the material of the invention further has a substantially higher impact energy than today's powder-metallurgical materials.

DETAILED DESCRIPTION OF THE INVENTION

The amount of Mo in the material should be 0.3–3.5% by weight, preferably 0.5–2.5% by weight, and the amount of P should be 0.3–0.7% by weight, preferably 0.35–0.65% by weight, most preferably 0.4–0.6% by weight. Further, the amount of other alloying elements should not exceed 2% by weight, preferably not more than 1% by weight, and most preferably not more than 0.5% by weight. In Addition, C may be present in a maximum amount of 0.1% by weight, preferably 0.07% by weight.

This powder can be produced by making a base powder of pure Fe, or Fe and Mo in solid solution. This can be produced either as a water-atomised powder or as a sponge powder. Suitably, the base powder is annealed in a reducing atmosphere to lower the content of impurities. Then, the powder is mixed with P, or Mo and P, and is compacted into the desired shape, whereupon sintering is carried out a temperature which advantageously is below 1150° C.

EXAMPLE

A base powder of Fe containing 1.5% by weight of Mo was prepared by water-atomisation. Then, 0.5% by weight of P was added. Test pieces were produced by compacting at a pressure of 4–8 ton/cm$^2$. The test pieces were sintered at 1120° C. for 30 min. The resulting densities and impact energies are apparent from the upper curve in FIG. 1, where the compacting pressure in ton/cm$^2$ is the parameter. For instance, an impact energy of 180 J and a density of 7.46 g/cm$^2$ were obtained at a compacting pressure of 8 ton/cm$^2$.

Figure 1:
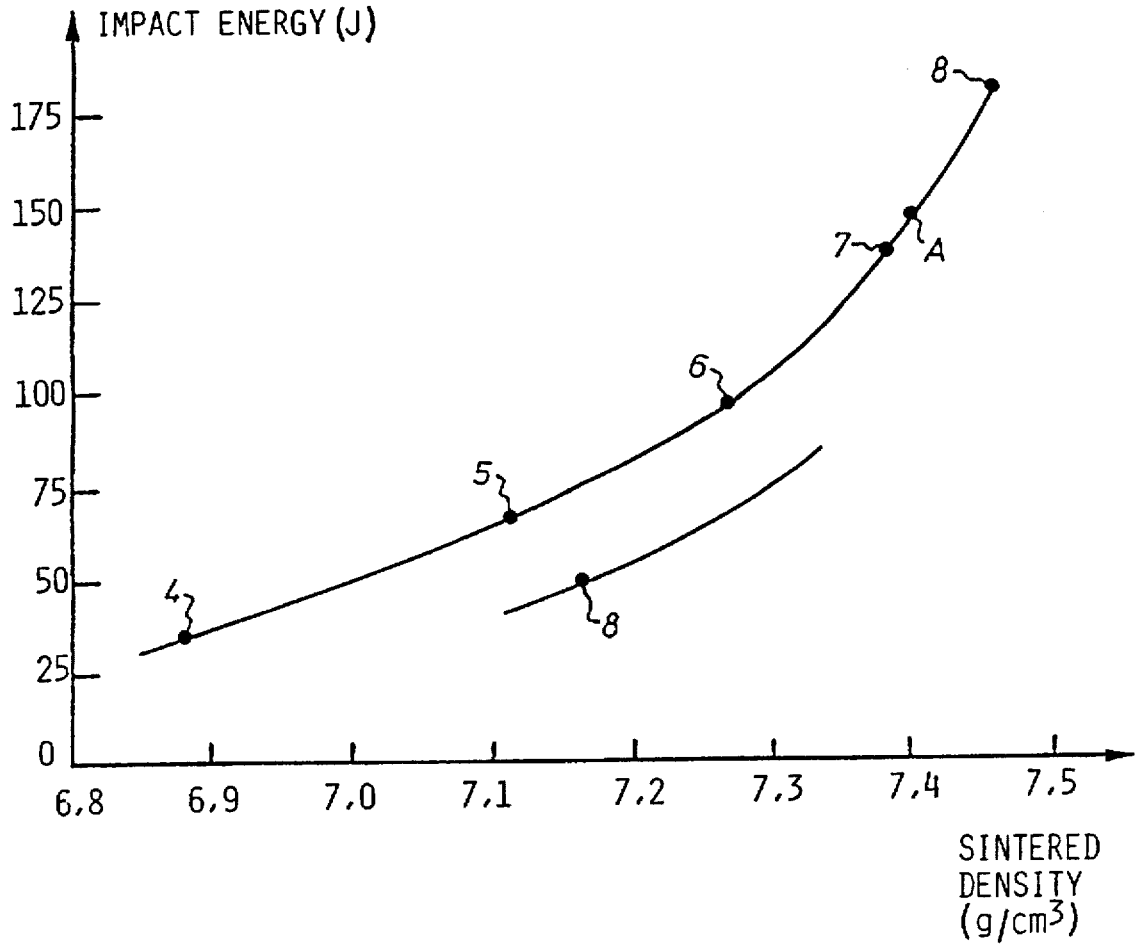
FIG. 1 is a graph of impact energy versus sintered density.

A test piece produced in the manner described above, but without Mo, had a much lower impact energy, as is apparent from the lower curve in FIG. 1.

At high-temperature sintering, the material shrinks more, which leads to higher density and, consequently, to higher impact energy. This is illustrated by the point A on the upper curve in FIG. 1, which was obtained at a compacting pressure of 6 ton/cm$^2$ and by sintering at 1250° C. for 30 min.

It should be observed that the combined addition of P and Mo results in a higher sintered density than does a binary system of Fe and P, even if subjected to double compacting. For one and the same density, the material of the invention further gives a much higher impact energy, which in all probability should be attributed to a more active sintering and a positive interaction between Mo and P.

Figure 2:
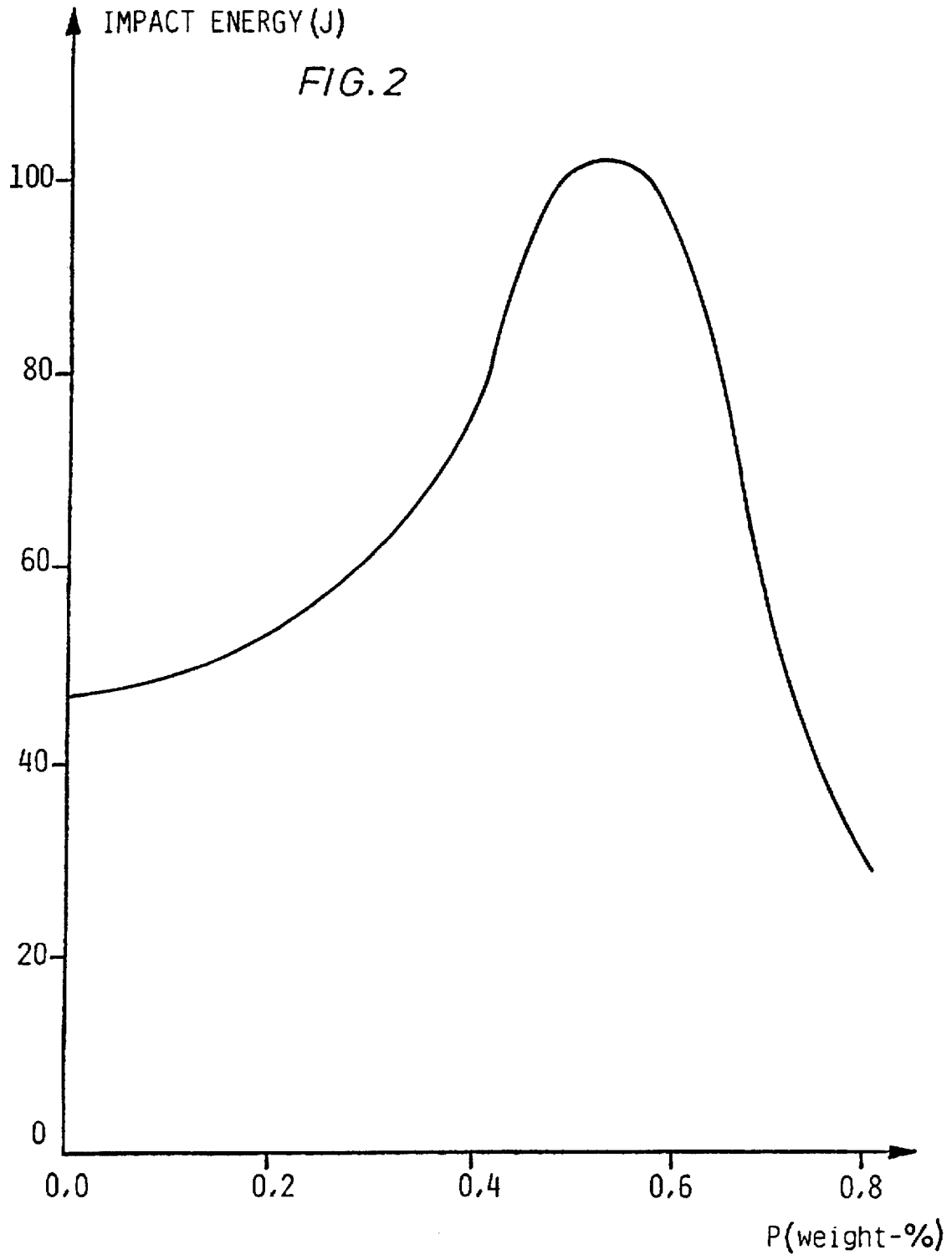
FIG. 2 is a graph of impact energy versus P content.

A powder according to the invention containing 1.5% by weight of Mo and varying amounts of P in the range of 0–0.8% by weight was produced. Test pieces were made by compacting at 589 MPa and sintering at 1120° C. The resulting impact energy in J is apparent from FIG. 2. As shown therein, a maximum value is achieved at 0.5% by weight of P; good values are obtained in the range of 0.3–0.7% by weight of P; even better values are obtained in the range of 0.35–0.65% by weight of P; and the best values are obtained in the range of 0.4–0.6% by weight of P.

Figure 3:
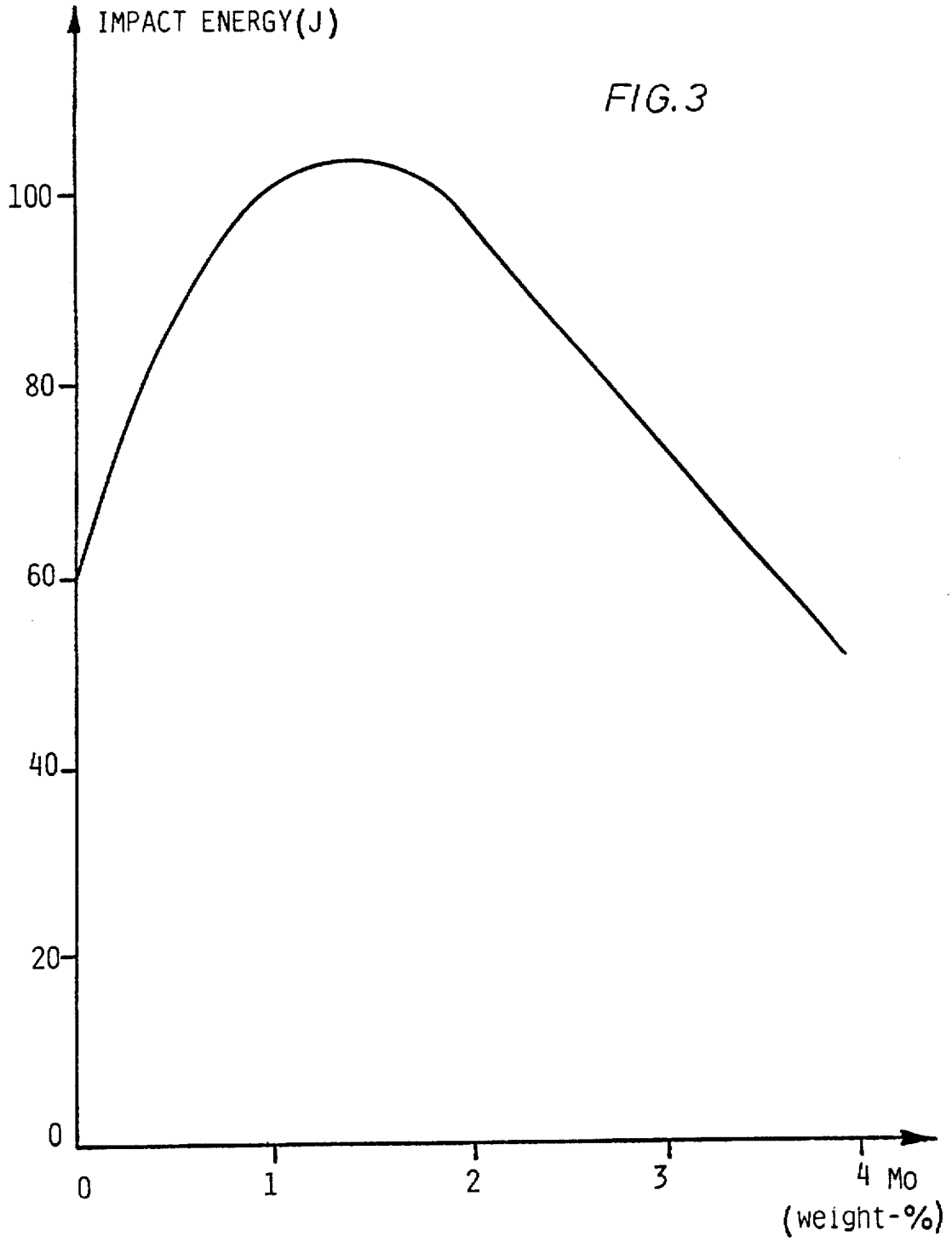
FIG. 3 is a graph of impact energy versus Mo content.

Similarly, a powder containing 0.5% by weight of P and varying amounts of Mo in the range of 0–4% by weight was produced. Test pieces were produced by compacting at 589 MPa and sintering at 1120° C. The resulting impact energy values are apparent from FIG. 3. As shown therein, 0.3–3.5% by weight of Mo constitutes a useful range, whereas 0.5–2.5% by weight of Mo constitutes a preferred range.

Very likely, the results obtained are due to the following. The addition of P entails that a liquid phase is obtained during sintering at a comparatively low temperature, resulting in a better distribution of P in the material. P diffuses into the iron particles, and, to some extent, austenite is transformed to ferrite, which facilitates the diffusion of Mo. Both P and Mo are ferrite stabilisers, and the transformation to ferrite increases the self-diffusion of Fe. This gives an active sintering, resulting in shrinkage and round pores.

Suitably, P is present in the form of a phosphor compound, preferably iron phosphide, e.g. $Fe_3P$.

The other alloying elements may be of a type not affecting the impact energy adversely, and common in powder metallurgy. As non-restrictive examples, mention may be made of Ni, W, Mn and Cr. Cu should not be used at all.

We claim:

1. An iron-based powder for producing impact-resistant components by powder compacting and sintering, consisting essentially of iron, 0.43–0.6% by weight of P, 0.5%–2.5% by weight of Mo, and 2% by weight or less of other alloying elements commonly used in powder metallurgy and not affecting the impact energy adversely.

2. The powder of claim 1, wherein P is present as iron phosphide.

3. The powder of claim 1, wherein the other alloying elements do not exceed 1% by weight.

4. The powder of claim 1, wherein the alloy has no more than 0.1% by weight of C.

5. A powder-metallurgically produced component, consisting essentially of iron, 0.43%–0.6% by weight of P, 0.5%–2.5% by weight of Mo, and 2% by weight or less of other alloying elements commonly used in powder metallurgy and not affecting the impact energy adversely.

6. The component as set forth in claim 5, wherein the composition consists of iron, 0.43%–0.6% by weight of P, 0.5%–2.5% by weight of Mo, and 2% by weight or less of other alloying elements commonly used in powder metallurgy and not affecting the impact energy adversely.

7. A compacted and sintered component of an iron-based powder consisting essentially of, in weight %, 0.43 to 0.6% P, 0.5 to 2.5% Mo, and balance Fe.

8. The component of claim 7, having $\leqq$0.1% C.

9. The component of claim 7, wherein the component is essentially free of Cu.

10. A method of powder-metallurgically producing impact-resistant steel components from an iron-based powder consisting essentially of iron, 0.43–0.6% by weight of P, 0.5%–2.5% by weight of Mo, and 2% by weight or less of other alloying elements commonly used in powder metallurgy and not affecting the impact energy adversely, the method comprising compacting the powder into a compact of desired shape and sintering the compact.

11. The method as set forth in claim 10, wherein the other alloying elements do not exceed 0.5% by weight.

12. The method as set forth in claim 10, wherein the alloy has no more than 0.1% by weight of C.

13. The method as set forth in claim 10, wherein the other alloying elements do not exceed 1% by weight.

* * * * *